US005358110A

United States Patent [19]

Simpson

[11] Patent Number: 5,358,110

[45] Date of Patent: Oct. 25, 1994

[54] VIDEO CAMERA CARRYING CASE

[76] Inventor: Jeffery T. Simpson, 1926 E. 6400 South, Salt Lake City, Utah 84121

[21] Appl. No.: 119,354

[22] Filed: Sep. 9, 1993

[51] Int. Cl.[5] ..... B65D 85/38

[52] U.S. Cl. ..... 206/316.2; 224/241

[58] Field of Search ..... 206/316.316.2; 224/240, 224/241, 253, 908

[56] References Cited

U.S. PATENT DOCUMENTS

| | | | |
|---|---|---|---|
| 1,513,176 | 10/1924 | Lyde | 206/316.2 |
| 2,560,335 | 7/1951 | Ericson | 206/316.2 |
| 3,520,241 | 7/1970 | Caldwell | 206/316.2 |
| 3,762,616 | 10/1973 | Brunstetter . | |
| 3,813,017 | 5/1974 | Pimsleur . | |
| 4,093,010 | 6/1978 | Hunley | 206/316.2 |
| 4,431,041 | 2/1984 | Leiserson . | |
| 4,463,789 | 8/1984 | Leiserson | 206/316.1 |
| 4,513,877 | 4/1985 | Taguchi et al. | 220/335 |
| 4,545,414 | 10/1985 | Baum . | |
| 4,923,060 | 5/1990 | Breslau . | |
| 5,092,458 | 3/1992 | Yokoyama . | |
| 5,092,459 | 3/1992 | Uljanic et al. | 206/305 |
| 5,205,448 | 4/1993 | Kester et al. | 206/316.2 |
| 5,251,800 | 10/1993 | Leenders | 224/908 |

FOREIGN PATENT DOCUMENTS

| | | | |
|---|---|---|---|
| 1088453 | 10/1967 | United Kingdom | 206/316.2 |

*Primary Examiner*—Jimmy G. Foster
*Attorney, Agent, or Firm*—Mallinckrodt & Mallinckrodt

[57] ABSTRACT

A protective carrying case for a video camera has peripheral side walls and a bottom wall defining a camera-receiving receptacle with an open top through which a camera can be inserted and removed. The case is provided with a top cover that is arranged to normally close the open top of the camera-receiving receptacle, and a side wall of the receptacle is preferably provided with a door-opening that is normally closed by a door for enabling a person carrying the encased camera to slip a hand into the receptacle when the door is partially or fully open for operating the camera, either without removing it from the case and its receiving receptacle or for removing the camera free and clear of the case and its receiving receptacle. In the former instance, the bottom of the receptacle is provided with openings for the objective lens and the microphone of a received camera and the cover for the open top of the receptacle is provided with an opening for the view finder of a received camera, such openings being covered with light or sound passing material as appropriate. The door-opening and the door therefor preferably extend across the width of the receptacle side wall which confronts the operating side of the received camera, with a portion thereof overlapping an adjoining side wall, and, in the latter instance noted above, both the door-opening and the door extending upwardly from a location above the bottom of the receptacle to coincidence with the open top of the receptacle, so the camera can be lifted free and clear for operation outside the case.

15 Claims, 6 Drawing Sheets

VIDEO CAMERA CARRYING CASE

BACKGROUND OF THE INVENTION

1. Field

The invention is in the field of carrying cases for video cameras.

2. State of the Art

Video cameras have become very popular with people who carry such cameras during all types of activities in order to record portions of the activity. Usually it is desired to be able to easily carry and protect the camera until the specific portion of the activity to be filmed is reached. For example, a skier may want to carry a video camera during skiing until a particular location is reached where filming takes place, or a biker may want to carry a video camera during biking until a particular location for filming is reached. Carrying of the camera should interfere with the activity engaged in as little as possible and, when filming is desired, access to the camera should be as easy, fast, and direct as possible.

Two general types of video camera cases are currently available. One type is a soft bag with a top portion adapted to open to allow access to the inside of the bag. The camera is placed inside the bag for storage and transport and the bag is carried by a hand or shoulder strap. The second type is a rigid case in which the camera is transported and stored. Such rigid case generally has a handle by which it is carried similarly to a suitcase or briefcase. While the rigid case may offer better protection for the camera or may provide for a set arrangement of camera and accessories within the case, the soft bag with shoulder strap is generally easier to carry during most activities. However, neither type of case is particularly easy to carry while engaging in vigorous activities such as skiing or biking. Further, neither case provides easy access to the camera stored therein. With each type of case, opening of the case, removing the camera from the case, and properly positioning the camera in the hand (normally with the hand passing between the usual handstrap and the body of the camera, so as to be properly positioned for securely holding and operating the camera) require considerable time and effort.

Most cameras have a shoulder strap attached thereto so that the camera, alone, can be transported by a user. However, the camera so carried, or a camera within a case that is similarly carried by a shoulder strap, is free to swing around during carrying, and, if the camera is not in a case, it is subject to being damaged when carried during vigorous activities.

SUMMARY OF THE INVENTION

In accordance with the invention, whether the carrying case is flexible like a bag or is rigid, it has peripheral side walls and a bottom defining a video-camera-receiving receptacle which is preferably open at its top for receiving and removing the camera but is normally closed by a cover that is preferably hinged to the receptacle, spring biased into open position, and provided with means for latching it in closed position. So that the person carrying the encased camera, as by means of the usual shoulder strap or by easily removable attachment by modern securement means to a belt of clothing being worn, can quickly and easily reach a hand into the case and place the camera into operating position without removing it from the case or can quickly and easily remove the camera from the case for operation free and clear of the case, the receptacle part of the case is provided with a door-opening in one or more of its peripheral side walls and a door for closing such opening. Thus, because the door is normally closed, the camera is protected from inclement weather until the case is purposely opened.

A video camera is normally provided with a handstrap so that a hand of the user can be inserted under it for grasping and operating the camera by controls located nearby. The aforementioned door-opening is positioned so the person carrying the encased camera can place the hand under the strap as the hand reaches into the case and can either operate the camera while it is in the case or can easily remove the camera from the case. To enable an inserted hand to easily remove the camera from the case, it is necessary that the door-opening terminate in coincidence with, and therefore in open communication with, the open upper end of the receptacle.

The door for closing and opening the door-opening is secured to the receptacle, as by a hinge or hinges, and, as with the closure cover, is preferably spring biased to open partially or wholly when a catch normally holding it closed is released as by the user pressing a button. Preferably a single button is arranged to control both the catch holding the cover closed and the catch holding the door closed.

So that the camera can be effectively operated while in the case, in accordance with one embodiment of the invention the closed bottom of the receptacle is preferably provided with an opening (covered by a transparent material) confronting the location of the objective lens of the camera and with an opening (covered by a material porous to sound) confronting the location of a microphone. The microphone is normally located in the front of the camera adjacent to the objective lens thereof. Also, the cover that normally closes the opposite, open, upper end of the receptacle is preferably provided with an opening (covered by a transparent material) confronting the location of the view finder of the camera.

It is preferred that the walls of the carrying case be somewhat flexible and that the case be contoured and provided with soft lining material so the case will closely hug the received camera and prevent undue movement thereof within the case while being carried.

THE DRAWINGS

The best mode presently contemplated for carrying out the invention is illustrated in the accompanying drawing in which:

FIG. 1 represents a skier carrying a typical video camera encased in accordance with the invention, the camera-receiving receptacle being shown with an access door-opening extending across one of the side walls thereof as well as across an adjacent portion of an adjoining side wall and the access door being shown as swung wide open primarily for purposes of illustration;

FIG. 2, a front, or outer side, elevation of the camera of FIG. 1 fully encased by reason of the access door being in its fully closed and latched position, the view being drawn to a considerably larger scale;

FIG. 3, a view corresponding to that of FIG. 2, but with the receptacle cover and the access door swung fully open as in FIG. 1 and shown only fragmentarily and with the lower part of the camera-receiving receptacle appearing in vertical section;

FIG. 4, a top plan view of the encased camera as shown in FIG. 2;

FIG. 5, a corresponding bottom plan view;

FIG. 6, a view corresponding to that of FIG. 2 but being an inner rather than an outer side elevation and showing normally preset camera controls as they appear through a protective window in the back side of the case; and FIG. 7, a view in perspective looking from the left in FIG. 1 but drawn to the scale of FIGS. 2–6, with the receptacle cover thrown open and with the access door thrown open only far enough to provide a relatively narrow slot for the insertion of a hand of the skier to grasp and lift the camera out of the open top of its receiving receptacle.

DETAILED DESCRIPTION OF THE ILLUSTRATED EMBODIMENT

Figure 2:
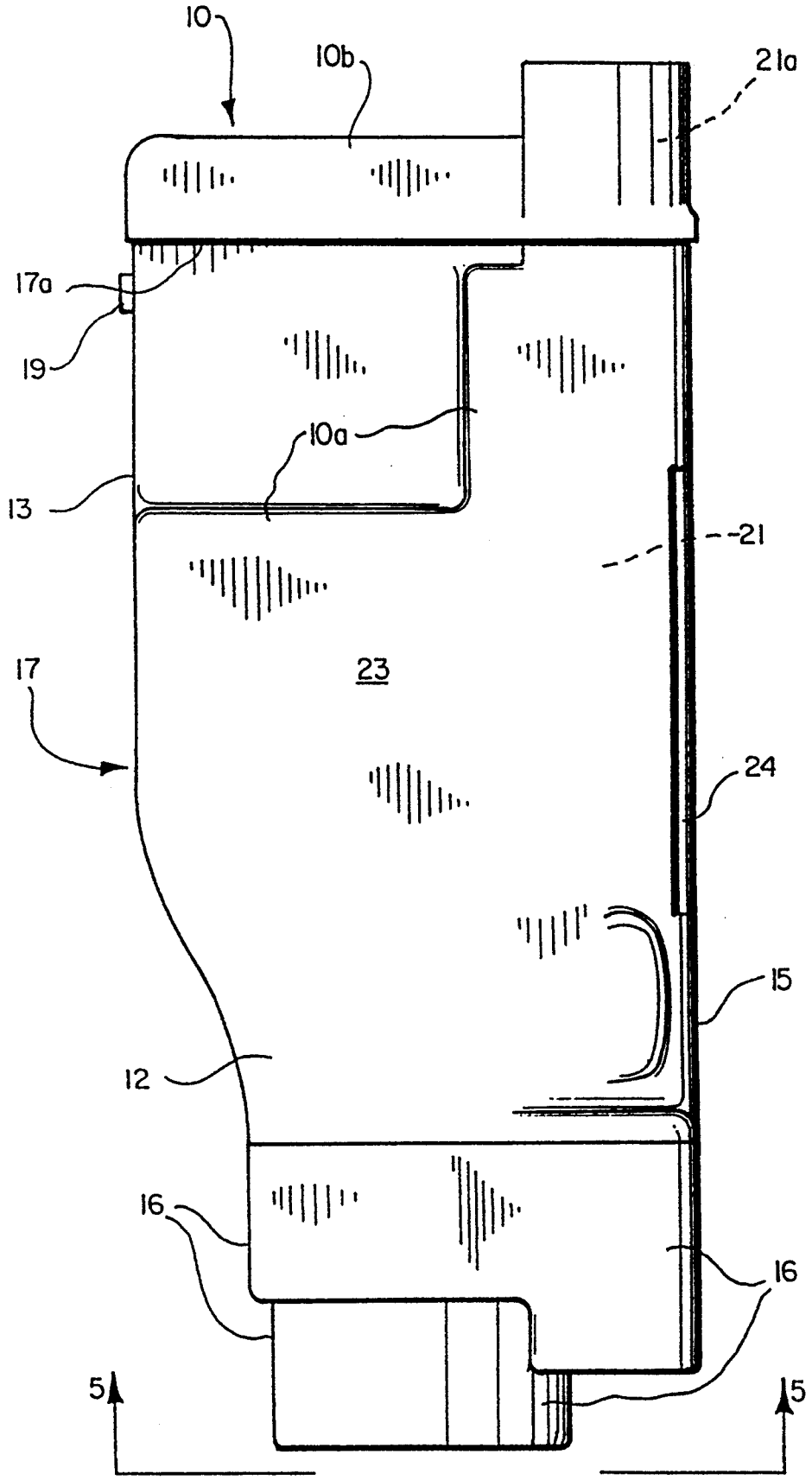
Figure 3:
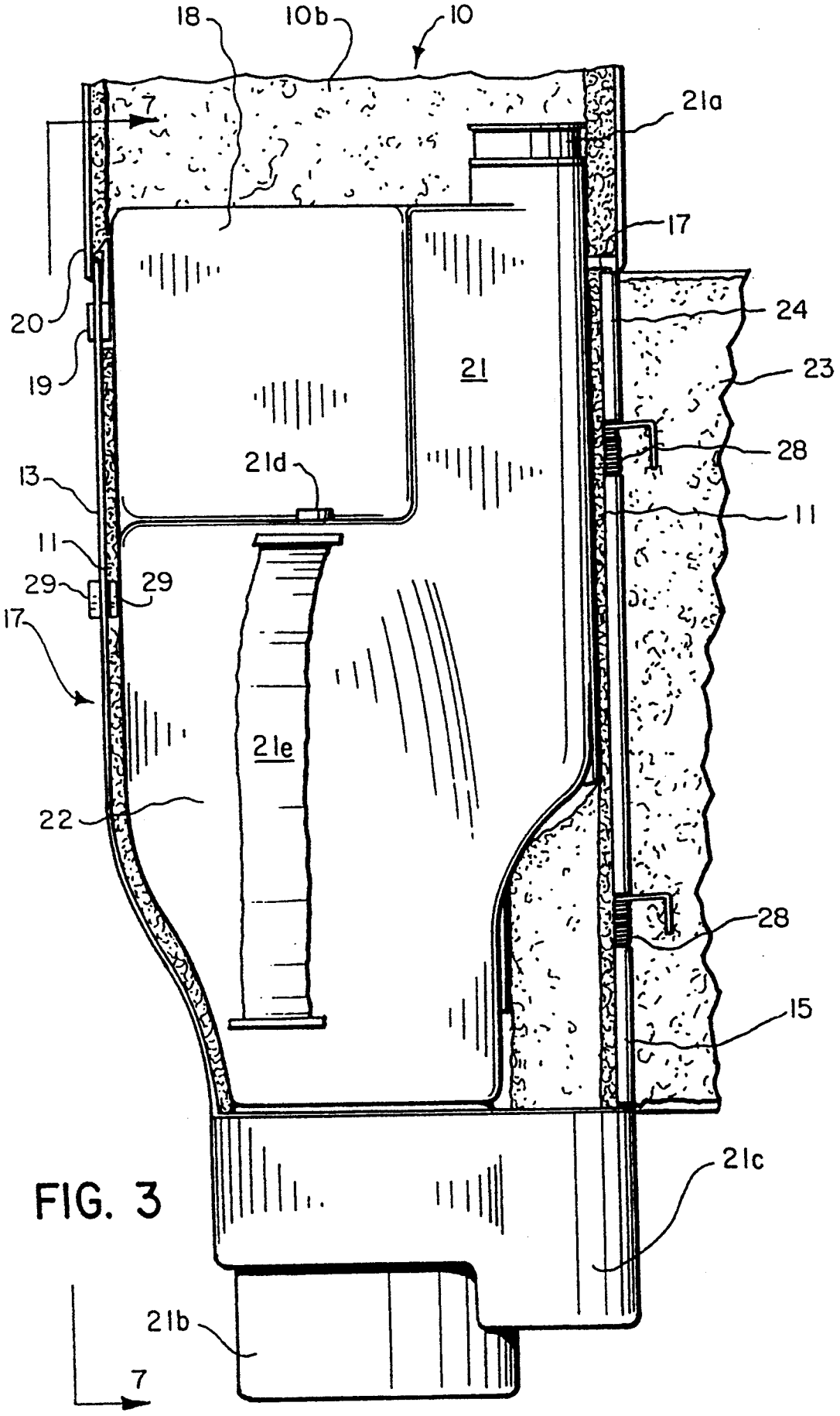
Figure 7:
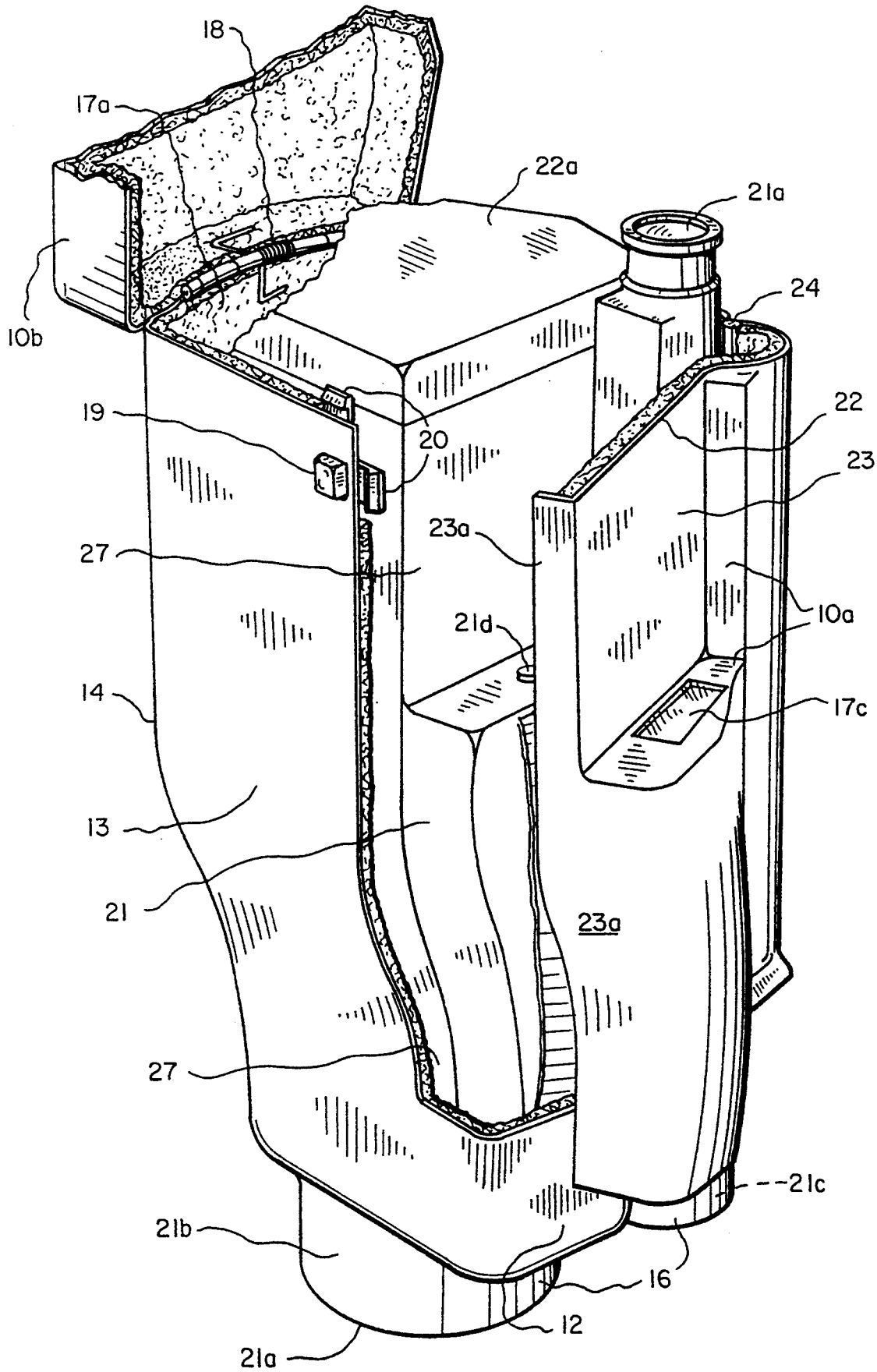

As illustrated, the carrying case 10 of the invention is somewhat flexible, contoured as at 10*a*, FIGS. 2 and 7, to conform with a typical video camera and lined with a soft material 11, FIG. 3, so as to closely hug the received camera and to substantially prevent relative movement between camera and case.

Figure 1:
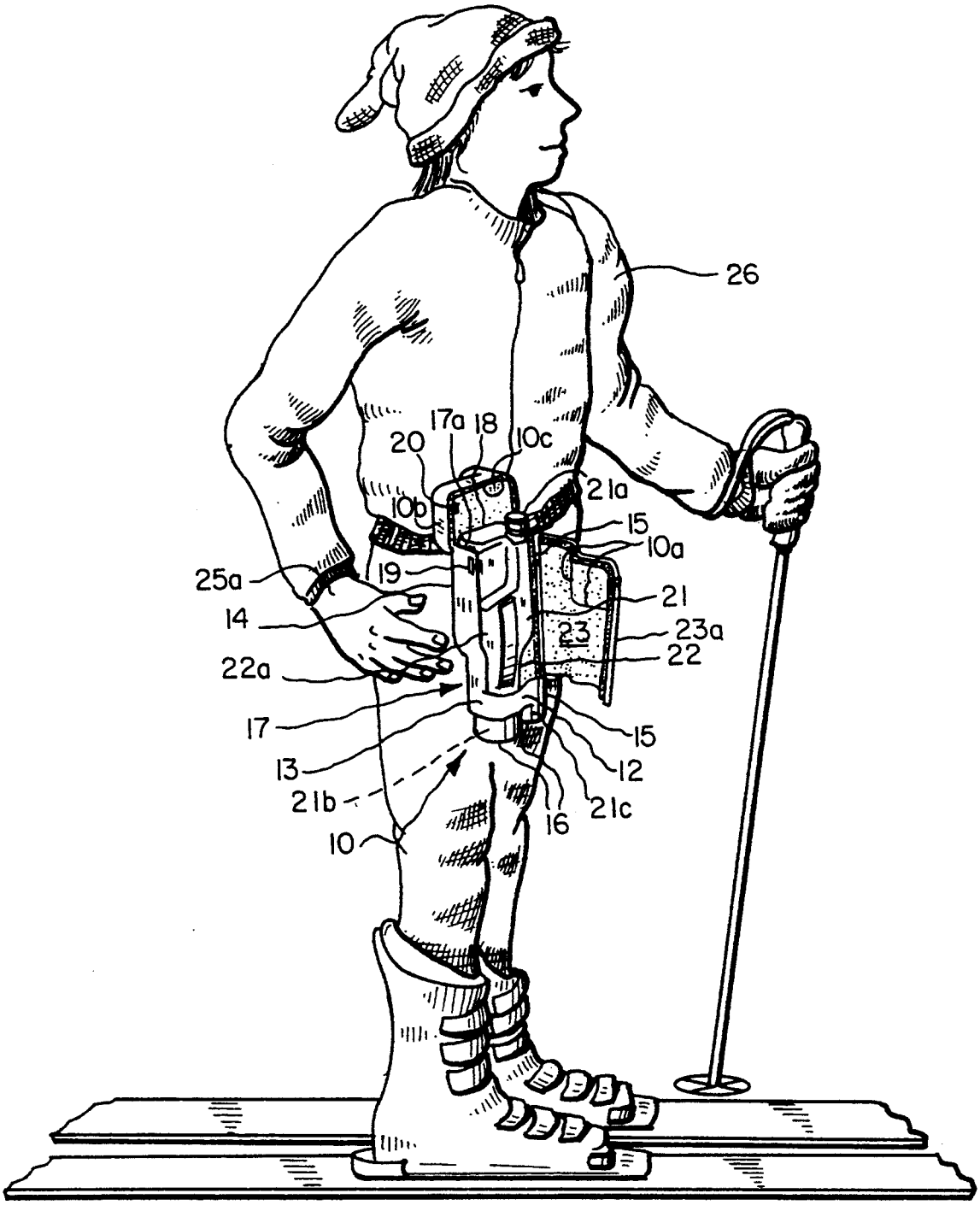
Figure 4:
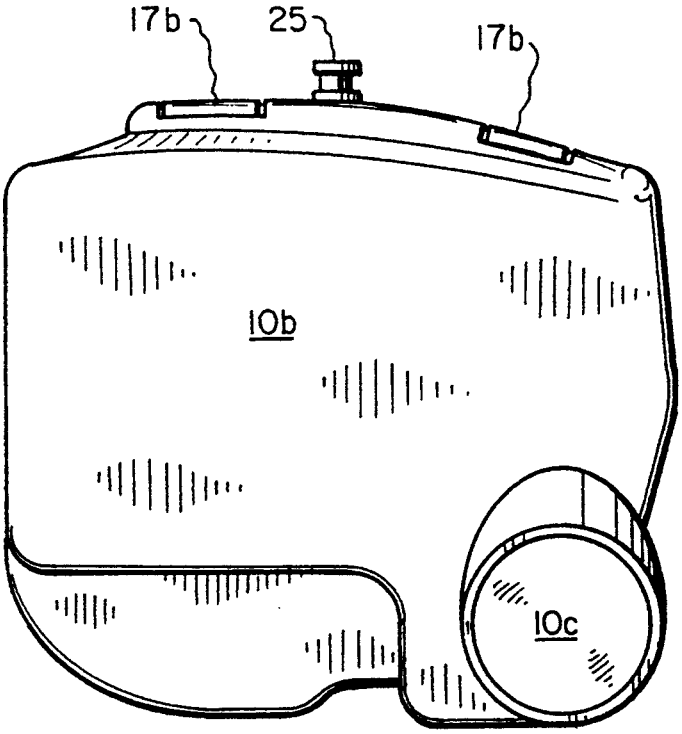

Camera case 10 has peripheral side walls 12, 13, 14, and 15, FIG. 1, and a closed bottom 16 defining a video-camera-receiving receptacle 17 having an open top 17*a* which is normally closed by preferably an at least semi-rigid, shape-retaining cover 10*b* adapted to overlap the upper end of receptacle 17 in a weatherproof manner. As shown, cover 10*b* is hinged, as at 17*b*, FIG. 4, to receptacle 17 and is spring biased, as at 18, FIG. 1, to open when button 19 is pushed to release the catch of a latch arrangement 20, FIG. 3. Cover 10*b* is preferably provided with a sighting opening therethrough covered by applied transparent material 10*c*, FIG. 4, placed to confront the view finder 21*a* of a typical video camera 21 within the case.

Figure 5:
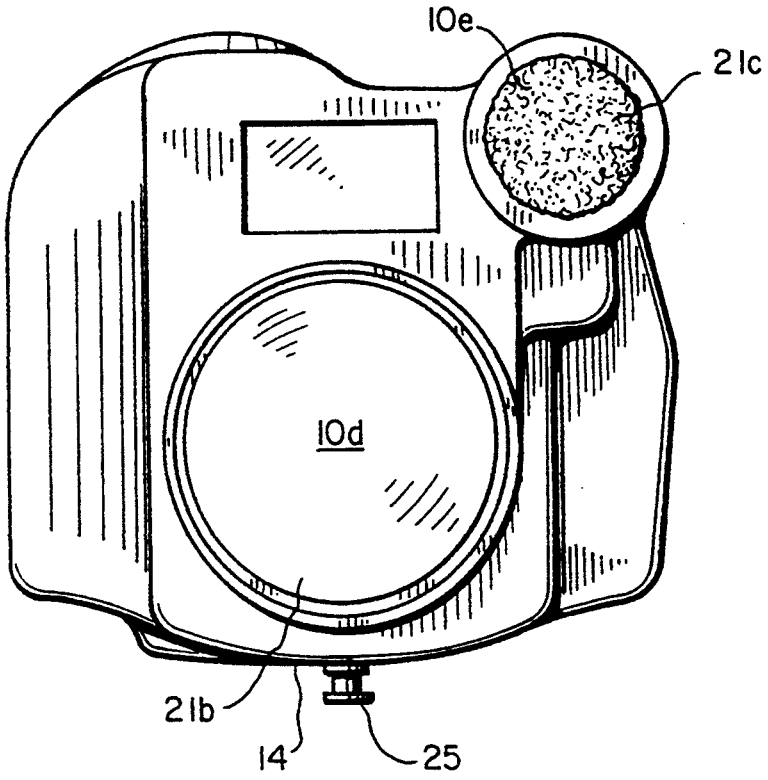

View finder 21*a* of the camera is normally uppermost in carrying case 10 and is positioned immediately under the transparent-material-covered opening 10*c* of cover 10*b*. The opposite or front end of the camera, see FIG. 5, is provided with an objective lens 21*b* and, usually closely adjacent thereto, with a microphone 21*c*, these being behind respective openings in the bottom 16 of case 10 covered, in accordance with the invention, by transparent material 10*d* and by sound porous material 10*e*, respectively. On one side wall of the camera adjacent to the usual on-off operating control 21*d* thereof, FIG. 3, is a handstrap 21*e* under which the hand of the user is normally placed for holding the camera in operating position during use.

In accordance with the invention, one of the peripheral side walls of case 10 and of receptacle 17, here the front wall 12, FIGS. 1 and 2, is provided with a door-opening 22 extending across its width and partially across, see 22*a*, FIG. 7, the width of adjoining side wall 13. Such door-opening 22 and its extension 22*a* are normally closed by a door 23 having an extension 23*a*, door 23 being shown here as attached to the camera-receiving receptacle 17 by means of an elongate hinge 24, FIG. 2. Door 23 and its extension 23*a* are normally closed when the encased camera is being carried.

As here shown, FIG. 5, a belt-attachment type of pin-fitting 25 projects from the back wall 14 of case 10 for readily separable securement to a receiving fitting (not shown) on the belt holding up the trousers of a skier 26, FIG. 1 or a belt provided specially for holding the carrying case. Thus, the camera is protected in inclement weather or from the rigors of being carried, but is still capable of being used while still in the case, with door 23 and its extension 23*a* partially open, by the user inserting a hand through the relatively narrow slot opening 27, FIG. 7, thereby provided by door extension 23*a* as the control button 21*d* is pushed. By clutching the camera with the hand that is inserted under the camera handstrap 21*e*, and by raising it to operative position with its covered view finder 21*a* against the eye, a video film can be made with the camera still in the case and partially covered.

Although it is not necessary, as explained above, that provision be made for removing the camera from the case for use, it is preferable that door-opening 22 and its extension 22*a* extend to coincidence with the open upper end 17*a* of camera-receiving receptacle 17, so the camera that is held by the hand inserted through the open side and front of the case, can be lifted free of the case and of the receptacle thereof and removed therefrom for use entirely outside of the case. It can then be easily returned to the case and its receiving receptacle following the desired period of use.

As with cover 10*b* of case 10, door 23 is preferably spring-biased, as at 28, FIG. 3, and provided with a button-operated latching arrangement 29 so as to spring at least partially open to at least provide the slot opening 27, FIG. 7, when it is desired to either operate the camera while still in the case or when it is desired to remove the camera extremely free of the case and of its receiving receptacle for operation entirely outside of the case. Either way, it is advantageous and therefore preferable that its extended door-opening 22*a* and the extension door 23*a* lap over as previously described from the side wall 12 to an adjoining side wall, here 13, so as to provide at least a side door-opening, as at 27. Of course, if merely such a side door-opening is desired, the entire door-opening and door could be located in the side wall, 13.

Moreover, if a camera case is desired that provides only for use, at intervals, of the camera as fully encased, rather than being operated in a partially opened case or when the camera is entirely removed from the case, no door-opening nor door therefor need be provided so long as transparent coverings for the view finder, the objective lens, and the microphone are provided and the camera-operating, on and off control button 21*d* is operable from outside the case. The latter is provided for by contouring a portion of the receptacle 17 over the control button 21*d*, see FIG. 7, and by making it sufficiently flexible, as by the provision of a flexible window 17*c*, to enable the user to operate such button by finger pressure exerted from outside the case.

Figure 6:
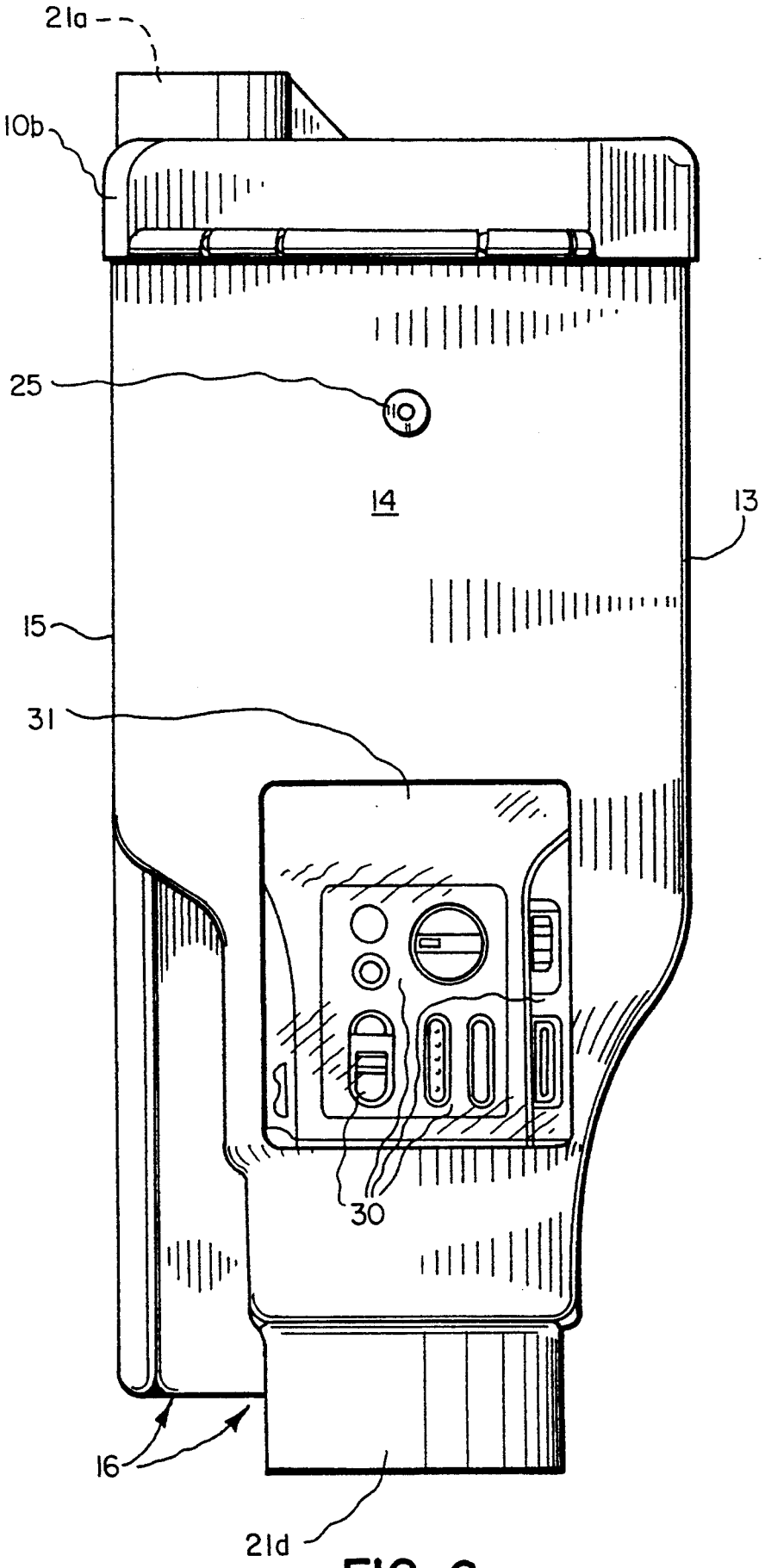

Regardless of how the case is made, however, the longtime settable controls 30, FIG. 6, such as date and shutter settings, may be, in accordance with the invention, covered by a transparent window covering 31 affording visual inspection at all times. Such covering 31 is preferably sufficiently flexible to enable control adjustment from outside the case as may be necessary or desireable from time to time.

Although release of the latching arrangements 19 and 29 for closure cover 10*b* and door 23, respectively, are here shown as controlled by separate buttons, they could be arranged for release by a single button located for convenient operation by a finger of the person carrying the encased camera, as shown in FIGS. 1 and 7.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A video camera carrying case for holding a video camera that has an operating control, a forward portion with an objective lens and a microphone, a rearward portion with a view finder, and an operating side portion adjacent to said operating control and provided with a hand strap, the camera being adapted to be held in operating position and to be operated by a hand of a person carrying it that is inserted between the hand strap and said operating side portion of the camera, said carrying case comprising peripheral side walls defining a video-camera-receiving receptacle having an open top for receiving the camera with its rearward portion uppermost, having a closed bottom, and having a door-opening through a side wall thereof that opens into said operating side portion of the camera and that is normally outermost from the body of a person carrying the camera; a cover for closing the top of said receptacle; and a door secured to said receptacle so as to normally close the said door-opening, whereby the hand of a user may be inserted through said door-opening and under the hand strap of the camera when said door is opened, there being openings at the bottom of the receptacle for the lens and the microphone, respectively, of a received camera, said openings being covered by a transparent material and a sound-passing material, respectively, and the cover for the top of the receptacle being provided with an opening for the view finder of the received camera, which opening is covered by a transparent material, so the camera can be effectively operated without removing it from the case during inclement weather or when it is desired to protect the camera during use.

2. A carrying case according to claim 1, wherein the case is provided with means whereby the operating control of the camera can be operated from the outside of the case.

3. A video camera carrying case holding a video camera that has an objective lens at one end, a view finder at an opposite end, an operating control, and an operating side portion adjacent to said operating control and provided with a hand strap, the camera being adapted to be held and operated by the hand of a user inserted between the hand strap and said operating side portion of the camera, said carrying case comprising peripheral side walls defining a video-camera-receiving receptacle that is normally open at one end for receiving the camera and that is closed at an opposite end, one of which side walls is provided with a door-opening; and a door secured to said receptacle and adapted to be closed and opened for covering and uncovering, respectively, said door-opening so as to enable the insertion of a hand of a user into the receptacle and under the hand strap of said camera.

4. A carrying case according to claim 3, wherein carrying case is provided with a transparent window in a side wall thereof that confronts longtime settable controls so the settings of said controls can be viewed from the outside of the case.

5. A carrying case according to claim 4, wherein the transparent window is flexible so said controls can be set from outside the case.

6. A video camera carrying case for holding a video camera that has an operating control, a forward portion with an objective lens and a microphone, a rearward portion with a view finder, and an operating side portion adjacent to said operating control and provided with a hand strap, the camera being adapted to be held in operating position and to be operated by a hand of a person carrying it that is inserted between the hand strap and said operating side portion of the camera, said carying case comprising peripheral side walls defining a video-camera-receiving receptacle having an open top for receiving the camera with its rearward portion uppermost, having a closed bottom, and having a door-opening through a side wall thereof opening into the interior of said receptacle from adjacent to said bottom of said receptacle to said open top thereof; a cover for closing the top of said receptacle; and a door secured to said receptacle on a hinge axis that extends from adjacent to said bottom of said receptacle to said open top thereof so as to normally close the said door-opening, whereby the hand of a user may be inserted through said door-opening and under the hand strap of the camera when said door is opened at least partially.

7. A carrying case according to claim 6, wherein the door is hinged to the receptacle for opening and closing movement relative to the door-opening and is provided with spring means normally biasing the door open and with latch means for holding the door closed.

8. A carrying case according to claim 6, wherein the cover for the top of the receptacle is hinged to the receptacle for opening and closing the open top of the receptacle and is provided with spring means normally biasing said cover open and with latch means for holding said cover closed.

9. A carrying case according to claim 6, wherein the receptacle and its cover are contoured to closely hug a received camera and are lined with a relatively soft protective material that substantially precludes movement of the camera within the receptacle.

10. A carrying case according to claim 6, wherein the door opening in the receptacle extends from a location between the bottom and the top thereof to coincidence with the open top of the receptacle so a received camera can be easily grasped and removed from the case by a person carrying the encased camera and desiring to use the camera apart from the case.

11. A carrying case according to claim 6, wherein the carrying case is provided with a transparent window in a side wall thereof that confronts longtime settable controls so the settings of said controls can be viewed from the outside of the case.

12. A carrying case according to claim 11, wherein the transparent window is flexible so said controls can be set from outside the case.

13. A carrying case according to claim 11, wherein one of the ends of the receptacle is open and the door-opening extends to coincidence with said open one end of the receptacle, so the camera can be easily grasped and removed from the case by a person carrying the encased camera and desiring to use the camera apart from the case.

14. A video camera carrying case for holding a video camera that has an operating control, a forward portion with an objective lens and a microphone, a rearward portion with a view finder, and an operating side portion adjacent to said operating control and provided with a hand strap, the camera being adapted to be held in operating position and to be operated by a hand of a person carrying it that is inserted between the hand strap and said operating side portion of the camera, said carying case comprising peripheral side walls defining a video-camera-receiving receptacle having an open top for receiving the camera with its rearward portion uppermost, and having a closed bottom, a cover for closing the top of said receptacle; openings through said bottom of the receptacle for the lens and the microphone, respectively, of a received video camera, said openings being covered by a transparent material and a sound-passing material, respectively; and an opening through said cover of the receptacle for the view finder of a receiving video camera, which opening is covered by a transparent material, so a received video camera can be effectively operated without removing it from said carrying case during inclement weather or when it is desired to protect the camera during use.

15. A carrying case according to claim 14, wherein the case is provided with means whereby the operating control of the camera can be operated from the outside of the case.

* * * * *